United States Patent [19]

Kramer et al.

[11] 4,083,195

[45] Apr. 11, 1978

[54] REFRIGERATING AND DEFROSTING SYSTEM WITH DUAL FUNCTION LIQUID LINE

[75] Inventors: Daniel E. Kramer, Yardley, Pa.; Israel Kramer, Trenton, N.J.; Harold Kramer, Morrisville, Pa.; Lawrence C. Board, Dallas, Tex.; Ram Kumar Chopra; William Micai, both of Trenton, N.J.

[73] Assignee: Kramer Trenton Company, Trenton, N.J. ; by said Israel Kramer, Harold Kramer, Lawrence C. Board, Ram Kumar Chopra, William Micai

[21] Appl. No.: 788,325

[22] Filed: Apr. 18, 1977

Related U.S. Application Data

[63] Continuation-in-part of Ser. No. 678,477, Apr. 20, 1976, abandoned.

[51] Int. Cl.[2] ..... F25B 41/00; F25B 47/00

[52] U.S. Cl. ..... 62/196 B; 62/278

[58] Field of Search ..... 62/196 B, 278

[56] References Cited

U.S. PATENT DOCUMENTS

| | | | |
|---|---|---|---|
| 2,763,130 | 9/1956 | Henderson | 62/278 |
| 3,021,693 | 2/1962 | Aune | 62/278 |
| 3,188,829 | 6/1965 | Siewert et al. | 62/196 B |
| 3,248,895 | 5/1966 | Mauer | 62/196 B |
| 3,529,432 | 9/1970 | Nussbaum | 62/196 B |
| 3,636,723 | 1/1972 | Kramer | 62/278 |
| 3,822,562 | 7/1974 | Crosby | 62/278 |
| 3,939,668 | 2/1976 | Morris | 62/196 B |
| 3,994,142 | 11/1976 | Kramer | 62/196 B |

*Primary Examiner*—Lloyd L. King
*Attorney, Agent, or Firm*—Daniel E. Kramer

[57] ABSTRACT

A compression type refrigeration system including at least one frosting evaporator positioned to refrigerate air. The evaporator has a liquid refrigerant inlet to which is connected an expansion valve. The evaporator also has a hot gas inlet; a liquid line supplies liquid to the expansion valve; a branch in the liquid line controlled by a solenoid valve connects to the hot gas inlet. The condensing unit, which includes compressor, condenser, receiver and re-evaporator, are valve-controlled so that during refrigeration, discharge gas from the compressor flows through the condenser, receiver, liquid line and expansion valve seriatim, but during defrost, gas from the compressor bypasses the condenser and flows instead from the compressor through the receiver, liquid line and hot gas inlet of the evaporator seriatim.

27 Claims, 4 Drawing Figures

REFRIGERATING AND DEFROSTING SYSTEM WITH DUAL FUNCTION LIQUID LINE

This application is a Continuation-In-Part of an application Ser. No. 678,477 filed Apr. 20, 1976, now abandoned.

FIELD OF THE INVENTION

This invention relates to the field of mechanical refrigeration and further to the field relating to the periodic defrosting with hot gas of a frosted evaporator, and further to the field of hot gas defrosting in conjunction with air cooled systems employing uncontrolled condensers exposed to low ambients, and finally, to the field of refrigeration systems for hot gas defrost which employ only two conduits connecting the high side with the evaporator, namely, a normally sized suction line and a normally sized liquid line.

PRIOR ART

Refrigeration systems utilizing air cooled condensers have long been known. More recently, refrigeration systems employing air cooled condensers exposed to the outdoor ambient have been developed which included controls for reducing the condenser capacity available so that the high side and liquid line pressure remained essentially constant throughout system operation at cold ambient conditions. These winter controlled systems have been applied to hot gas defrost evaporators and, in at least one case, as exemplified by U.S. Pat. No. 3,637,005, have included a valve controlled system where only two pipes, a suction line and a liquid line, need be used to connect the refrigeration high side with the evaporator. To this date, these inventors do not know of any refrigeration system employing an uncontrolled air cooled condenser intended to be subject to cold winter outdoor ambient and for year-round operation which has been offered with or is capable of providing hot gas defrosting for the evaporator.

BRIEF SUMMARY OF THE INVENTION

On refrigeration the compressor pumps discharge vapor to the condenser, condenses the vapor to a liquid, and in turn delivers the liquid to the receiver. The liquid flows through the liquid line to the expansion valve, which lowers its pressure for evaporation in the evaporator. The vapor generated in the evaporator is conveyed back to the compressor via the suction line. During defrost, a solenoid valve at the inlet to the condenser closes, forcing vapor to flow directly to the receiver through a bypass provided for that purpose. A tee is provided in the liquid line near the evaporator and a solenoid-controlled branch is connected between the tee in the liquid line and the hot gas inlet to the evaporator. At the same time the discharge solenoid at the inlet to the condenser closes, forcing flow of discharge vapor to the receiver, the solenoid in the branch to the hot gas inlet of the evaporator opens; thereupon the charge of liquid refrigerant in the receiver and in the liquid line is blown through the evaporator into the suction line, allowing the direct entry of hot gas to the evaporator via the compressor discharge, the condenser bypass, receiver, liquid line and branch conduit. In addition, means for controlling the return of liquid refrigerant to the compressor are shown.

Figure 1:
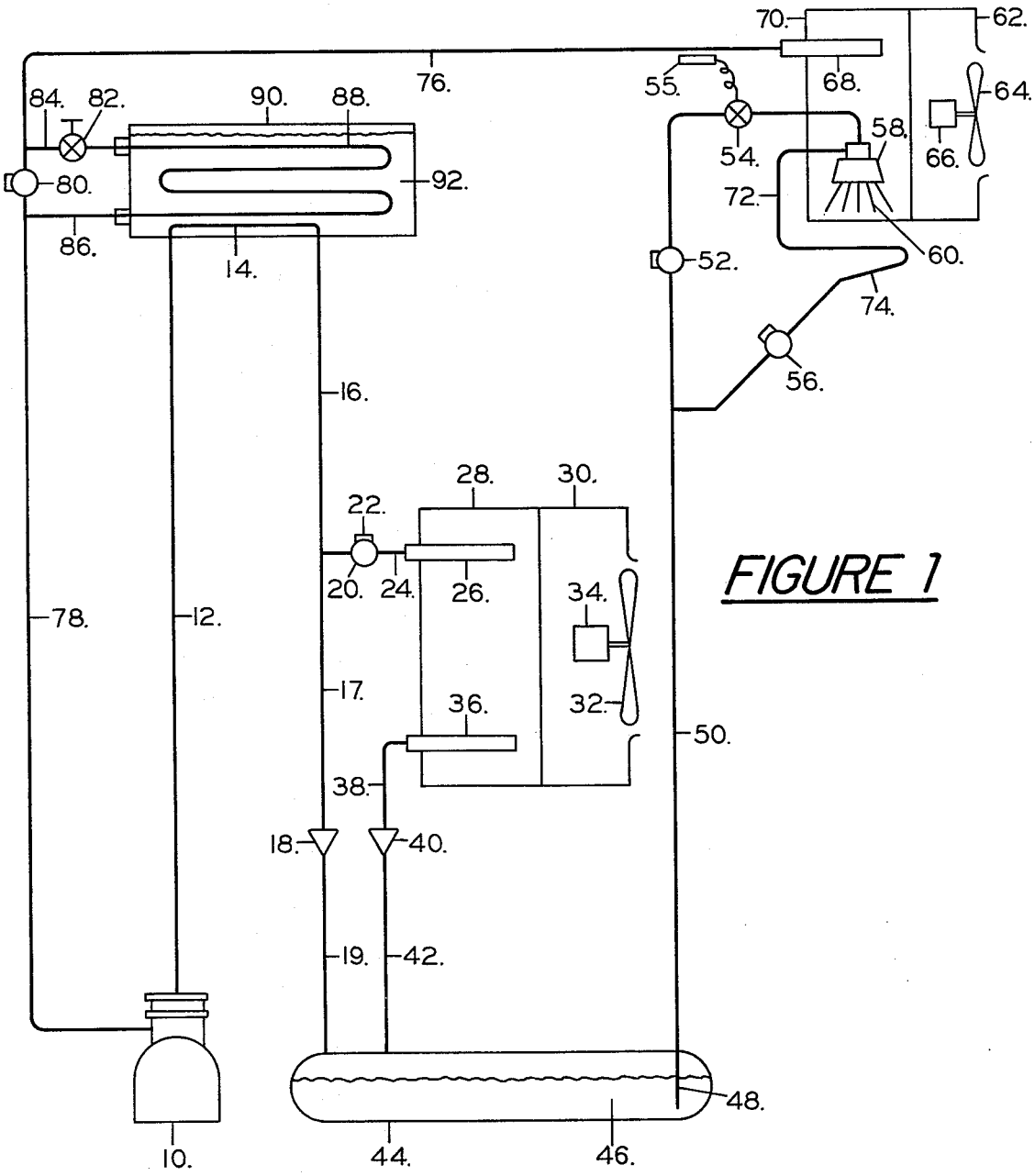
FIG. 1 is a schematic piping diagram of the system which includes the principle of the invention and has a heated re-evaporator interposed in the suction line to prevent return of liquid refrigerant to the compressor.

DETAILED DESCRIPTION OF THE DRAWINGS:

In FIG. 1, compressor 10 draws suction vapor from suction line 78 and delivers it compressed to a higher pressure into discharge line 12. The discharge vapor traverses heat exchange portion 14 which is immersed in a liquid heat storage for the purpose of defrost which will be described later and proceeds through conduit 16 toward the condenser. The vapor traverses open solenoid valve 20 which is controlled by coil 22 and enters the coil of air cooled condenser 28 through its inlet manifold 26. Air cooled condenser 28 is typically installed outdoors exposed to all ambients. It is sized sufficiently large to provide reasonable condensing temperatures during the highest expected summer ambients and has no controls associated with it for reducing or modulating its capacity during refrigeration (as distinct from defrost) operation. During both summer and winter, condenser coil 28 is cooled by air drawn over the coil by fan 32 which is driven by motor 34. Generally motor 34 is connected to turn off when compressor 10 stops operating. After the hot gas from the compressor discharge is condensed to a liquid in condenser coil 28, the liquid flows through the condenser outlet 36, outlet conduit 38 containing check valve 40 into receiver inlet conduit 42 and into the receiver 44, wherein it collects as a pool of liquid 46. As required, the liquid is withdrawn from the receiver 44 via dip tube 48 and is delivered to the evaporator 70 by way of liquid line 50, liquid solenoid 52, liquid expansion valve 54 and distributor 58 with its distributing tubes 60. Within the evaporator 70 the cold liquid refrigerant boils to a vapor, abstracting heat from the air drawn over the evaporator by fan 64, driven in turn by motor 66. The resulting suction vapor is delivered back to the compressor through suction line 76, open suction solenoid valve 80 and suction line 78 to the inlet of compressor 10 for recycling. When the refrigerated space has become sufficiently cool, a thermostat, not shown, closes liquid solenoid 52, stopping the flow of liquid refrigerant to the expansion valve 54 and evaporator 70. The compressor 10 continues operation until the pressure in the low side of the system comprising the evaporator 70, suction line 76 and 78 and its associated piping are reduced to a sufficiently low pressure as determined by the setting of a low pressure switch, and at that point the power to the compressor motor 10 is terminated, whereby compressor 10 stops operation. During refrigeration, hot gas solenoid 56 remains closed. When defrost is required, upon initiation by a time clock or any other means, the following events occur: suction solenoid 80 closes, discharge solenoid 22 closes, hot gas solenoid 56 opens, liquid line solenoid 52 closes. Fan motor 66 stops operation, compressor 10 continues operation, or, if it has been off, the opening of the high side to the low side through hot gas solenoid 56 causes the pressure in the low side to rise and, in turn, causes the low pressure switch to close the contacts to the compressor motor, causing it to start operation. The compressor delivers vapor to discharge line 12, exchanger 14 and conduit 16. Solenoid valve 20 is closed. Therefore, vapor cannot enter condenser coil 28 and must instead push open spring loaded check valve 18. Spring-loaded check valve 18 is constructed with an internal spring which prevents its opening until the pressure difference across it is 15 or more PSI. The vapor, flowing through conduit 19, now is at a pressure approximately 15 PSI lower than the pressure of the vapor in conduit 18. The pressure of the vapor now imposed directly on the liquid 46 in the receiver 44 acts to push the liquid out of the receiver through dip tube 48 and into liquid line 50, where it is allowed to flow in relatively unrestricted fashion, since hot gas solenoid 56 has opened. The liquid traverses evaporator 70, suction line 76 and accumulates ahead of holdback valve 82. After all the liquid stored in the receiver 46 and liquid line 50 has traversed the evaporator 70, it is followed by hot gas from the compressor discharge. At the moment that suction line solenoid 80 closes, the unrestricted source of vapor to the compressor 10 is cut off and holdback valve 82 begins to feed the refrigerant accumulated ahead of it into the re-evaporating coil 88, which is immersed in the warmed liquid 92. The liquid 92 had been warmed by continued operation of the compressor and, in turn, by the warming effect of the heat exchange relationship with the portion of the discharge line 14 in heat transfer contact with the liquid 92. As the holdback valve 82 feeds liquid refrigerant into the reevaporator coil 88, that liquid evaporates to vapor, absorbing heat from the liquid 92, at the same time cooling it. The vapor now flows to the compressor through re-evaporator outlet 86 and suction line 78. The holdback valve 82 is adjusted so that the pressure in suction conduit 78 is no higher than the compressor 10 can tolerate without overloading. Hot gas line is connected to the liquid line 50 closer to the evaporator than the midpoint of the liquid line.

A few moments after defrost begins, the pressure of the refrigerant in condenser coil 28 may be higher than or lower than the pressure of the refrigerant in receiver 44. If the defrost period follows a period when the compressor was not in operation, then pressure in the condenser might be lower than the pressure in the receiver 44. Therefore, there would be incentive for flow from receiver 44 to condenser 28. However, check valve 40, in conduit 38, positioned at the outlet or condenser 28, prevents flow from the receiver 44 to the condenser 28 under these conditions. Therefore, the defrost process proceeds just as if the condenser 28 were not present. If the system begins the defrost operation during a period that the compressor has been operating, then the pressure within condenser 28 may be higher than the pressure in receiver 44 after a few moments of operation. Under these conditions, the accumulated gas and liquid, which constitutes the operating charge of condenser 28, will be discharged from the condenser 28 into the receiver 44 until the two pressures are equal. At that time, the pressure in the receiver 44 will continue rising and its pressure will surpass the pressure in the condenser 28. Then check valve 40 will close, preventing any reverse flow and the defrost operation will continue with the condenser isolated.

Figure 2:
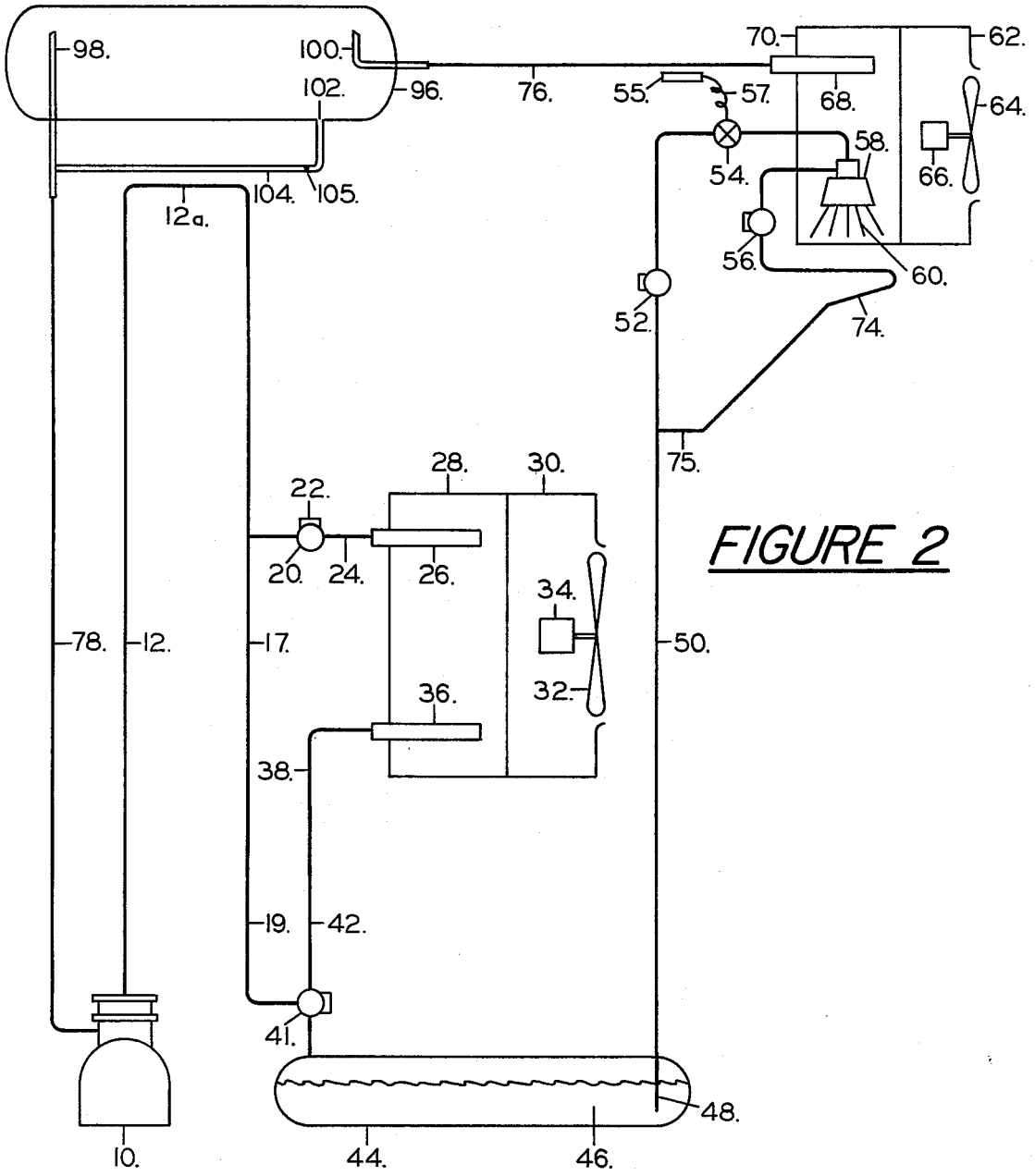
FIG. 2 is a schematic piping diagram of a refrigeration system embodying the principle of the invention which includes a suction accumulator in the suction line for catching liquid refrigerant returned through the suction and a three-way valve at the junction of the condenser bypass with the liquid conduit.

FIG. 2 illustrates the application of the invention to a refrigeration system which has no heat storage but instead has a suction accumulator in the suction line. On refrigeration cycles the compressor 10 withdraws vapor from suction line 78 and discharges it at higher pressure to discharge line 12, thence through open discharge solenoid 20 and into condenser coil 28, where the hot compressed refrigerant is condensed to a high pressure liquid which is delivered to receiver 44 via condenser outlet fitting 36, 3-way valve 41 (which simultaneously closes bypass 17 to flow) and receiver inlet conduit 42. As required, liquid refrigerant accumulated in the receiver is delivered through liquid line 50, liquid solenoid 52 and thermal expansion valve 54 to evaporator 70 via distributor 58 and distributing tubes 60. In the evaporator the refrigerant, whose pressure has been reduced, evaporates to a vapor and in so doing cools air drawn over the evaporator coil by fan 64, which, in turn, is driven by motor 66. The vapor and any entrained oil flows to suction accumulator 96, which is installed in suction line 76. In the accumulator, any entrained oil is separated out and separately flows into suction conduit 78 via liquid outlet 102 and restricted oil metering tube 104, containing orifice 105. Refrigerant vapor flows directly within the accumulator 96 from inlet fitting 100 to outlet fitting 98 and from the accumulator to the compressor for recompression via suction line 78.

Since it is intended that condenser 28 be installed outdoors, subject to all summer and winter conditions, it will be apparent that the temperature at which the refrigerant condenses in condenser 28 will be higher than the temperature of the air entering condenser coil 28 by a number of degrees we shall call T.D. For a given load and a given condenser the T.D. will be essentially constant under both summer and winter conditions. Under summer conditions, the pressure in the high side will be high; for example, with Refrigerant 502, 250–300 PSI; under winter conditions, the pressure in the high side will be relatively low, in the region of 80–100 PSI. Adequate flow of liquid refrigerant into evaporator coil 70 at low head pressure is achieved by proper selection of the port size in expansion valve 54 and proper arrangement of liquid line 50 so that essentially bubble-free liquid refrigerant can reach the inlet of expansion valve 54. U.S. Pat. No. 3,769,808 by Daniel Kramer describes winter operation of uncontrolled air cooled systems more fully. In order to ensure wintertime defrost, it is necessary to isolate condenser 28 in order to eliminate any effect of the cold ambient air on the temperature of the refrigerant flowing from the compressor to the evaporator. This invention achieves this isolation by the use of discharge line solenoid 20 and condenser outlet 3-way valve 41.

During defrost, discharge line solenoid 20 closes, hot gas solenoid 56 opens and 3-way solenoid 41 shifts to prevent flow to or from condenser outlet 36 and allow flow through condenser bypass 17. The compressor withdraws vapor from suction line 78 and delivers it to discharge line 12. The vapor cannot flow to condenser inlet 26 since the discharge solenoid valve 20 is closed. The vapor instead flows to receiver 44 through the now open bypass port of 3-way valve 41 where it displaces and pushes accumulated liquid 46 through dip tube 48 and liquid line 50, hot gas branch conduit 75, drain pan heating conduit 74, hot gas solenoid 56, through evaporator 70 and into accumulator 96 where the liquid refrigerant is caught and collected. The three way solenoid valve 41 is a combination in one body of a solenoid valve in the bypass line 17 which allows flow during defrost periods and a valve in the condenser outlet conduit 42 which prevents flow to the condenser during defrost periods. Some liquid can flow through outlet fitting 102 and orifice 105. This controlled amount of liquid refrigerant is reevaporated by the heat transferred to the liquid from discharge line 12, a portion of which, 12*a*, is disposed in heat transfer relationship with restricted liquid return conduit 104. Consequently, the refrigerant vapor returns to the compressor, essentially dry, or free of liquid refrigerant. The evaporating effect of tube 104 and discharge line portion 12*a*, persists throughout the defrost and refrigeration cycles. The discharge to suction heat exchange between tubes 12*a* and 104 causes almost no heating of the main suction stream because of the small flow through tube 104. The warming effect of the discharge portion 12*a* on the tube 104 extends upstream, past orifice 105, causing the normally cold oil there to be warmed and become less viscous, so that it can more readily flow through orifice 105.

Figure 3:
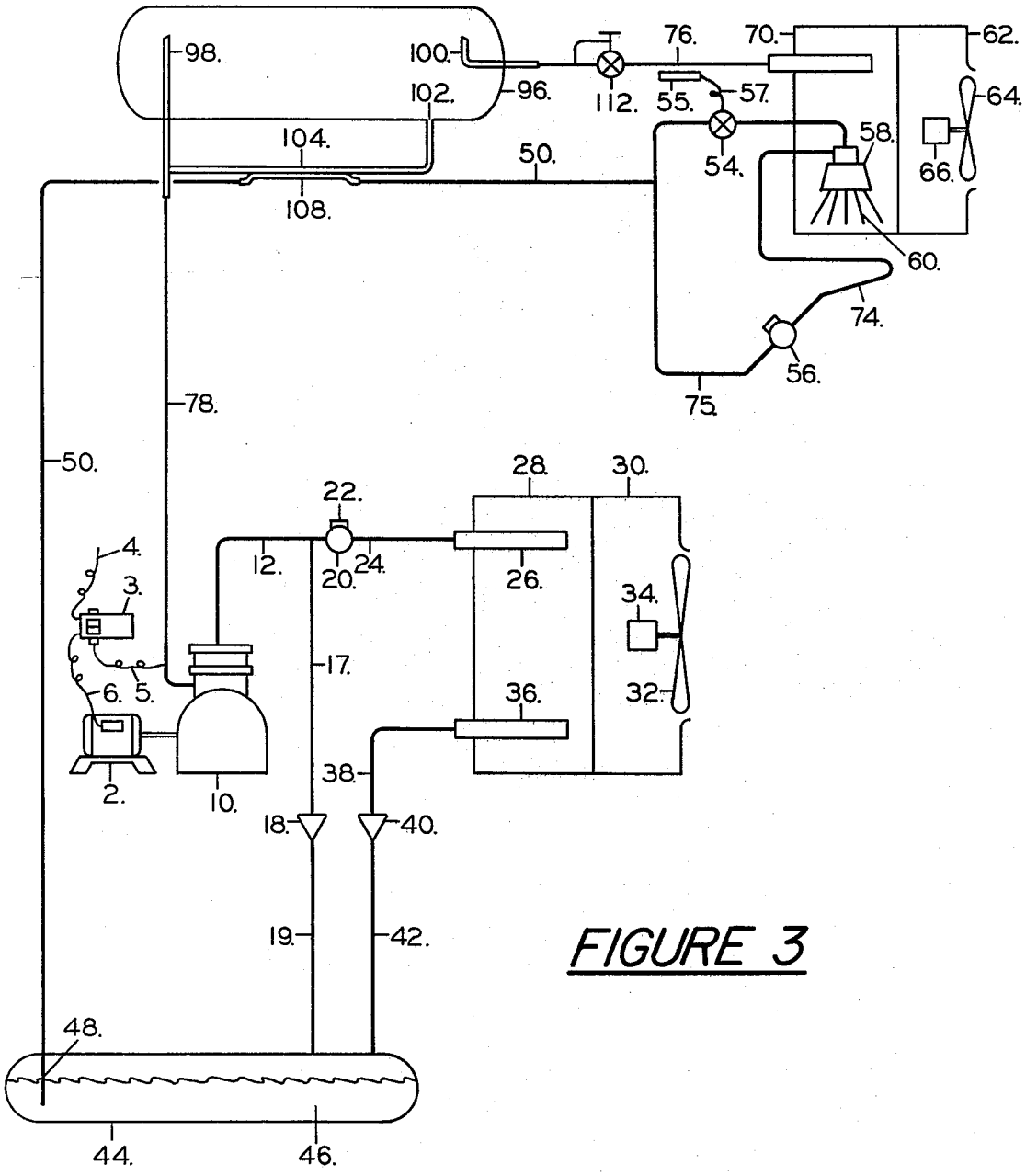
FIG. 3 is like FIG. 1 except a suction accumulator is provided instead of a heated reevaporator.

FIG. 3 shows a refrigeration system like that of FIG. 1 except that a suction accumulator is substituted for the heat storage type reevaporator.

During refrigeration, the operation of the system is as follows: compressor 10 withdraws refrigerant vapor from suction line 78, compresses it and discharges it at a higher pressure to discharge line 12. Vapor then enters condensing coil 28 through discharge solenoid 20. Solenoid 20 is always open during refrigeration. The refrigerant vapor discharged by compressor 10 is condensed to a liquid by transfer of its heat to air drawn over condenser 28 by fan 32, driven in turn by motor 34. The cooled, condensed liquid flows from the condenser coil 28 to its outlet fitting 36 through check valve 40 and then into receiver 44, where it collects as a pool 46. When the refrigerant flow is demanded by expansion valve 54, it is withdrawn from receiver 44 through dip tube 48. The liquid refrigerant flows through liquid line 50 in heat exchange relationship with liquid outlet tube 104 of accumulator 96, and thence to expansion valve 54, which is under the control of bulb 55, strapped to suction line 76 and connected to the expansion valve by capillary tube 57. The expansion valve serves to reduce the pressure and the temperature of the liquid refrigerant flowing therethrough to approximately the evaporating temperature of the system. At this temperature the liquid refrigerant withdraws heat from the air drawn over the evaporator 70 by fan 64, driven by motor 66. The heat put into the liquid refrigerant causes it to boil away to a vapor. The vapor traverses suction line 56, enters suction accumulator 96 via its inlet tube 100 and leaves the suction accumulator via outlet connection 98. The suction vapor from the suction accumulator is delivered to the compressor 10 via suction conduit 78. Under conditions where the compressor motor does not have sufficient power to operate the compressor under the high back pressure conditions which may result during defrost, holdback valve 112 at the accumulator inlet throttles to maintain the suction pressure at or below a predetermined setting.

During defrost, discharge solenoid 22 closes; hot gas solenoid 56 opens. With discharge solenoid 20 closed, no discharge vapor can enter the condenser 28 through conduit 24. The vapor, therefore, is forced to bypass the condenser through bypass conduit 17 and springloaded check valve 18 to enter the receiver. No vapor from the receiver can enter the condenser through its outlet conduit 38 since check valve 40 in that conduit is oriented to allow flow from the condenser outlet 36 but to prevent reverse flow. Therefore, all the discharge vapor enters th receiver 44 and imposes its pressure on any liquid 46 residing therein. Since the hot gas solenoid 56 has been opened, there is no restriction to flow into the evaporator 70 and all the liquid in the receiver 44 and in the liquid line 50 is pushed quickly into the evaporator 70. From the evaporator the liquid flows into suction line 76 and thence enters the suction accumulator 96 where it resides temporarily. Immediately following this rapid movement of the liquid, receiver 44 and liquid line 50 become conduits for the flow of hot gas from the compressor discharge which now enters the evaporator 70 warming it and causing it to defrost. Liquid refrigerant resulting from cooling of the vapor in the cold evaporator 70 is transmitted through suction line 76 to the suction accumulator 96 where it is separated from the vapor flow. All the vapor entering suction accumulator 96 plus whatever vapor is formed therein is transmitted to the accumulator outlet conduit 98 from which it flows directly to the compressor through suction conduit 78.

Figure 4:
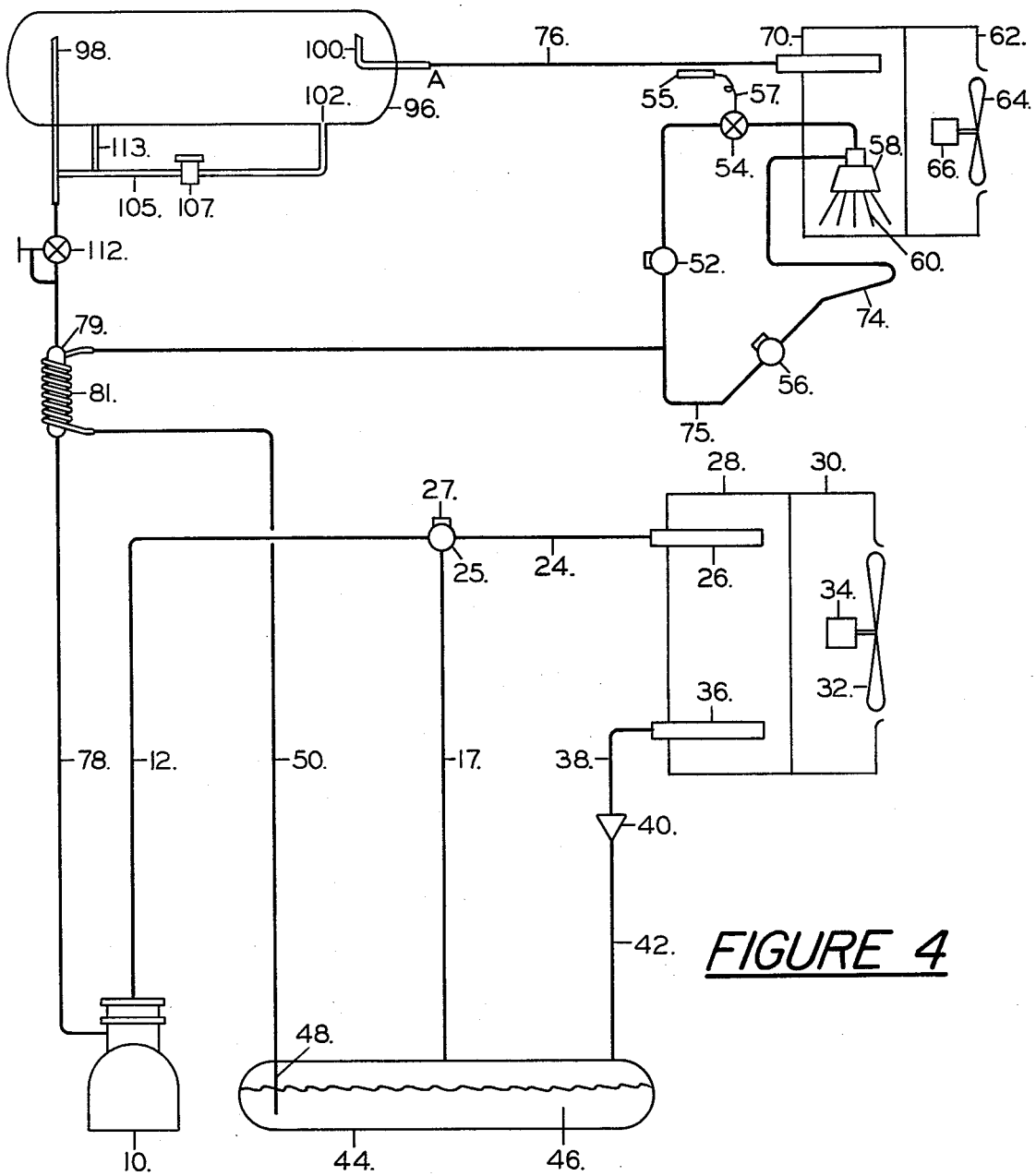
FIG. 4 employs a discharge line 3-way valve to control flow to the condenser and through the condenser bypass.

FIG. 4 is different from FIG. 2 in four ways:

A. The restricted metering tube 104 has been replaced with unrestricted drain tube 105 with valve 107 installed therein. Valve 107 is a thermal expansion valve with its bulb strapped on to tube 105 at the valve inlet. Valve 107 can also be a solenoid valve arranged to open during refrigeration cycles and to close during defrost and OFF cycles.

B. Restrictor tube 113 is provided bypassing valve 107, so that a limited quantity of the contents of tank 96 can flow to suction line 78 whenever valve 107 is closed.

C. A suction-liquid heat exchanger, comprising suction tube 79 with liquid tube 81 in close heat transfer contact, is provided in suction line 78. The portion 81 of the liquid line which is in thermal contact with suction tube 79 is connected into the liquid line 50 between the receiver 44 and the point of connection to the liquid line of hot gas branch 75.

D. Two-way solenoid valve 20 and spring loaded check valve 18 have been replaced by 3-way solenoid valve 25.

During defrost, hot gas solenoid 56 opens, 3-way solenoid 25 diverts flow direct to the receiver; evaporator fan motor 66 is turned off, but compressor 10 continues to operate. Discharge vapor withdrawn by the compressor from suction line 78 is compressed and delivered to the discharge conduit 12. Since the discharge vapor cannot reach condenser 28 because 3-way solenoid 25 has closed the route to the condenser, the vapor flows through conduit 17, the passage through which 3-way valve 25 has simultaneously opened, directly into liquid receiver 44. Check valve 40 serves to prevent any backward flow of either liquid refrigerant or hot gas from the receiver to the condenser during the course of defrost. Consequently, the entire supply of compressed refrigerant vapor delivered by compressor 10 must flow through the receiver 44, liquid line 50, the liquid tube 81 in heat exchanger 79/81, hot gas solenoid 56, drain pan heating coil 74, distributor 58, distributor tubes 60, evaporator coil 70 and into suction accumulator 96.

There, any liquid which had been entrained with the refrigerant vapor is separated out and the liquid-free vapor flows from inlet fitting 100 to outlet fitting 98 through suction holdback 112 and, at reduced and regulated pressure, through suction tube 79 of suction-liquid heat exchanger 79/81, suction line 78, back to compressor 10 for recycling. Refrigerant liquid collected in accumulator 96 is prevented from reaching the accumulator outlet fitting 98 by virtue of excess flow through liquid conduit 105 by thermal expansion valve 107, whose bulb is clamped to conduit 105 at the inlet side of the expansion valve. The bulb is operatively connected to the expansion valve diaphragm by way of a capillary tube. The thermal expansion valve is adjusted to be closed when its bulb senses about 5° F superheat, and to be open when the bulb senses superheat over 5° F. During the defrost or other periods, when liquid refrigerant has collected in suction accumulator 96, the bulb senses less than 5° F superheat and causes thermal expansion valve 107 to be closed, shutting conduit 105 to the flow of liquid refrigerant. Restricted conduit 113 bypasses valve 107 to allow small quantities of liquid refrigerant to flow from the accumulator 96 into suction line 78 for the purpose of facilitating defrost. The small amount of liquid refrigerant metered into the suction line by tube 113 is evaporated by passing in heat exchange contact with the hot gas stream traversing the liquid line portion 81 of the suction-liquid heat exchanger 79/81. When defrost is over, the liquid collected in accumulator 96 evaporates and meters slowly into the suction line 78 via restricted metering tube 113. When this liquid has been completely evaporated in heat exchanger 79/81 by heat exchange with the warm liquid flowing from receiver 44 through liquid portion 81 to expansion valve 54, its bulb will no longer sense less than 5° F superheat but instead will sense a higher superheat, for instance, 15° superheat; at that time, valve 107 will open wide, allowing essentially unrestricted flow between the interior of tank 96 and accumulator outlet fitting 98, so that any oil entrained with the refrigerant vapor and separated therefrom in accumulator 96 will be able to flow unrestrictedly back to the compressor. In an alternate construction, when valve 107 is a solenoid valve, it is closed during defrost and allowed to open only when defrost is completed or when a sensor, sensing the presence of liquid refrigerant in tank 96, indicates that the tank 96 is substantially empty of liquid refrigerant. During the refrigeration cycle, compressor 10 discharges compressed hot refrigerant vapor into its discharge line 12, by which it is conveyed into inlet 26 of condenser 28 and prevented from passing through bypass 17 by 3-way discharge solenoid valve 25. Within condenser 28 the warm refrigerant vapor is condensed to a liquid and flows to receiver 44 by way of liquid line 38. The liquid 46 is conveyed to expansion valve 54 by way of liquid line check valve 40, receiver 44, liquid line 50, liquid conduit 81 portion of suction liquid heat exchanger 79/81, and liquid solenoid 52. The liquid refrigerant is expanded to a low pressure by the expansion valve 54 and is evaporated to dryness in evaporator 70 while performing its primary function of cooling the air drawn over the evaporator 70 by the fan 64, driven by motor 66. The refrigerant vapor flows through suction line 76 into suction accumulator 96 out of suction accumulator through its outlet fitting 98 to the compressor by way of suction line 78. Its flow is controlled by holdback valve 112, shown positioned at the outlet of the suction accumulator, but with a possible alternate position at its inlet at the position shown as A. The refrigerant vapor is warmed on its passage from the accumulator to the compressor by traversing suction liquid heat exchangers 79/81 and being brought in thermal contact with warm liquid refrigerant traversing liquid conduit 81 which is a portion of liquid line 50.

Although the invention has been shown in connection with certain specific embodiments, those skilled in the art will readily recognize that various changes in form and arrangements of parts may be made to suit individual requirements without departing from the spirit and the scope of the invention except as defined and limited by the following claims.

We claim:

1. An improved refrigeration system having refrigeration periods and defrost periods comprising: a compressor having an inlet connection and a discharge connection; air cooled condenser means adapted to be exposed to summer and winter conditions, said condenser means having an inlet and an outlet; first conduit means connecting the compressor discharge to the condenser inlet for conveying vapor thereto; frosting and defrosting evaporator means having at least one inlet and a suction outlet; expansion means for metering refrigerant liquid to an evaporator inlet; liquid conduit means for conveying refrigerant from the condenser outlet to the expansion means; a check valve having an inlet and an outlet in the liquid conduit means, said valve positioned to allow flow from the condenser outlet and to prevent reverse flow; a liquid receiver located in the liquid conduit means between the check valve and the expansion means, said receiver having an inlet and an outlet; and a suction conduit connecting said suction outlet with the compressor inlet, wherein the improvement comprises —

(a) First valve means positioned in the first conduit for allowing flow to the condenser inlet during refrigerating periods and positively preventing said flow during defrost periods;

(b) hot gas conduit means connecting the liquid conduit means at a point between the receiver outlet and the expansion means, with an evaporator inlet for providing flow thereto;

(c) second valve means for allowing flow through the hot gas conduit means during defrost periods and for preventing said flow during refrigerating periods;

(d) bypass conduit means for conveying vapor from the first conduit means to the receiver; and (e) third valve means in the bypass conduit means for allowing hot gas flow therethrough during defrosting periods and preventing said flow during refrigerating periods;

whereby hot gas is caused to flow in the receiver and the liquid conduit during defrost periods.

2. A system as in claim 1 which includes heat storage means for receiving liquid refrigerant from the evaporator and evaporating it.

3. A system as in claim 1 which includes tank means for receiving suction vapor and liquid from the evaporator suction outlet and for allowing the flow of the vapor to the compressor and for restricting the flow of liquid.

4. A system as in claim 3 which includes heat exchange means for warming the fluid leaving the vapor outlet means.

5. A system as in claim 3 where the tank means includes a liquid outlet and a liquid outlet conduit connecting the liquid outlet with the vapor outlet.

6. A system as in claim 3 which includes heat exchange means for warming the fluid traversing the liquid outlet conduit.

7. A system as in claim 6 where the heat exchange means includes a portion of the first conduit.

8. A system as in claim 6 where the heat exchange means includes a portion of the liquid conduit means.

9. A system as in claim 1 where first valve means and third valve means are combined in a single three-way valve.

10. A system as in claim 1 which includes outlet pressure regulator valve means installed in the suction conduit for preventing the pressure at the compressor inlet from rising above a predetermined value.

11. A system as in claim 10 where the regulator valve is positioned at the accumulator inlet.

12. An improved refrigeration system having refrigeration periods and defrost periods comprising:

(a) a compressor having an inlet connection and a discharge connection;

(b) air cooled condenser means adapted to be exposed to summer and winter conditions, said condenser means having an inlet and an outlet;

(c) a first conduit for vapor flow connecting the compressor discharge and the condenser inlet; first valve means positioned in the first conduit for allowing vapor flow to the condenser inlet during refrigerating periods and positively preventing said flow during defrost periods;

(d) frosting and defrosting evaporator means having at least one inlet and a suction outlet;

(e) expansion means for metering refrigerant liquid to an evaporator inlet;

(f) liquid conduit means for conveying refrigerant from the condenser outlet to the expansion means; condenser outlet valve means located in the liquid conduit means for allowing flow from the condenser outlet during refrigeration periods and for preventing flow during defrost periods;

(g) a liquid receiver located in the liquid conduit means on the outlet side of the condenser outlet valve means;

(h) bypass conduit means for conveying vapor from the first conduit to the receiver; and second valve means in the bypass conduit means for preventing vapor flow therethrough during refrigerating periods;

(i) a hot gas conduit connecting the liquid conduit means with an evaporator inlet; third valve means for allowing flow through the hot gas conduit during defrost periods and for preventing said flow during refrigerating periods;

(j) suction conduit means for conveying refrigerant from the evaporator outlet to the compressor.

13. A system as in claim 12 which includes heat storage means for receiving liquid refrigerant from the evaporator and evaporating it.

14. A system as in claim 12 which includes tank means, said tank means having a vapor outlet, for receiving suction vapor and liquid refrigerant from the evaporator and for allowing the flow of the vapor to the compressor and for restricting the flow of liquid.

15. A system as in claim 14 where the tank means includes a liquid outlet and a liquid conduit connecting the liquid outlet with the vapor outlet.

16. A system as in claim 12 where said condenser outlet valve means and said second valve means are combined in a single valve means having a first and a second mode, said single valve means constituting means for allowing flow from the condenser outlet and simultaneously preventing flow through the bypass in the first mode, and positively preventing flow from the condenser outlet and allowing flow through the bypass in the second mode.

17. A system as in claim 15 which includes restriction means in the liquid conduit and fourth valve means in said liquid conduit for bypassing the restriction means and for providing restricted flow when said fourth valve means is closed.

18. A system as in claim 15 which includes heat exchange means for warming the fluid leaving the tank.

19. A system as in claim 18 where the warming passage of the heat exchange means is a portion of the liquid conduit means.

20. A system as in claim 18 where the heat exchange means includes a portion of the first conduit.

21. A system as in claim 12 which includes outlet pressure regulator valve means installed in the suction conduit means for preventing the pressure at the compressor inlet from rising above a predetermined value.

22. A refrigeration system having refrigerating periods and defrost periods, said system having: compressor, discharge line, condenser, liquid line, expansion device, and defrosting evaporator, conduit connected seriatim; a condenser bypass, said bypass connecting the discharge line with the liquid line; a hot gas line connecting the liquid line to the evaporator; first valve means in the hot gas line for controlling flow therethrough; wherein the improvement comprises: second valve means in the discharge line for positively stopping flow to the condenser during defrosting periods; and third valve means in said bypass for allowing flow through the bypass during defrosting periods.

23. A system as in claim 22 which includes fourth valve means in the liquid line for allowing flow from the condenser during refrigeration periods and preventing flow during defrost.

24. A system as in claim 23 which includes a liquid receiver in the liquid line positioned between the fourth valve means and the expansion device.

25. A system as in claim 24 where the hot gas conduit is connected to the liquid line at a position closer to the expansion device than a point in the liquid line midway between the condenser outlet and the expansion device.

26. A system as in claim 22 where the second valve means and the third valve means are combined into a single valve body.

27. A system as in claim 22 where the third valve means and the fourth valve means are combined into a single valve body.

* * * * *